US010638846B2

(12) United States Patent
Smith et al.

(10) Patent No.: US 10,638,846 B2
(45) Date of Patent: May 5, 2020

(54) CHAIR

(71) Applicant: Union Design Development LLC, East Greenville, PA (US)

(72) Inventors: Shaun Smith, Harleysville, PA (US); Jeffery Theesfeld, Schwenksville, PA (US)

(73) Assignee: UNION DESIGN DEVELOPMENT LLC, East Greenville, PA (US)

( * ) Notice: Subject to any disclaimer, the term of this patent is extended or adjusted under 35 U.S.C. 154(b) by 20 days.

(21) Appl. No.: 16/032,165

(22) Filed: Jul. 11, 2018

(65) Prior Publication Data

US 2019/0014908 A1 Jan. 17, 2019

Related U.S. Application Data

(60) Provisional application No. 62/531,631, filed on Jul. 12, 2017.

(51) Int. Cl.

| | |
|---|---|
| ***A47C 7/40*** | (2006.01) |
| ***A47C 9/02*** | (2006.01) |
| ***A47C 1/024*** | (2006.01) |
| *A47C 7/48* | (2006.01) |

(52) U.S. Cl.

CPC ..... *A47C 7/407* (2013.01); *A47C 1/0244* (2013.01); *A47C 9/025* (2013.01); *A47C 7/405* (2013.01); *A47C 7/48* (2013.01)

(58) Field of Classification Search

CPC ..... A47C 7/405; A47C 7/407; A47C 7/48; A47C 9/025

USPC ..... 297/354.11, 378.1

See application file for complete search history.

(56) References Cited

U.S. PATENT DOCUMENTS

| | | | |
|---|---|---|---|
| 3,511,533 A | 5/1970 | Drabert | |
| 4,537,445 A | 8/1985 | Neuhoff | |
| 5,295,728 A | 3/1994 | Schaevitz | |
| 5,328,237 A | 7/1994 | Yamaguchi et al. | |

(Continued)

FOREIGN PATENT DOCUMENTS

| | | | |
|---|---|---|---|
| DE | 2716209 A1 * | 10/1978 | ..... A47C 7/407 |
| EP | 179748 A2 | 4/1986 | |
| JP | H11-75990 A | 3/1999 | |

OTHER PUBLICATIONS

International Search Report and Written Opinion of the ISA for related International Application No. PCT/US2018/041544 filed Jul. 11, 2018.

*Primary Examiner* — Syed A Islam

(74) *Attorney, Agent, or Firm* — Howson & Howson LLP

(57) ABSTRACT

A chair is provided having at least one leg with an upper end on which a seat component is supported and a backrest interconnected to and projecting from the seat component. The backrest comprises a lower backrest section, an upper backrest section, and a backrest hinge interconnecting the upper backrest section to an upper end of the lower backrest section. The lower backrest section is interconnected to and extends from a rear portion of the seat component and the backrest hinge is configured to permit the upper backrest section to be located in an upright position in which the upper backrest section projects above the lower backrest section and is configured to permit the upper backrest section to be pivoted to a forward position in which the upper backrest section extends laterally over and spaced above the seat component.

17 Claims, 7 Drawing Sheets

(56) References Cited

U.S. PATENT DOCUMENTS

| | | | | |
|---|---|---|---|---|
| 5,447,358 | A | 9/1995 | Corlett | |
| 5,597,203 | A | 1/1997 | Hubbard | |
| 5,630,648 | A | 5/1997 | Allard et al. | |
| 6,116,682 | A | 9/2000 | Baur | |
| 7,293,825 | B2 | 11/2007 | Vergara et al. | |
| 8,096,615 | B2 * | 1/2012 | Parker | A47C 1/023 297/284.3 |
| 8,220,872 | B2 | 7/2012 | Hong | |
| 8,602,496 | B2 * | 12/2013 | Lu | A47C 7/448 297/285 |
| 9,474,377 | B2 | 10/2016 | Keen et al. | |
| 2003/0151288 | A1 | 8/2003 | Deiseg | |

* cited by examiner

CHAIR

CROSS REFERENCE TO RELATED APPLICATIONS

This application claims the benefit under 35 USC § 119(e) of U.S. Provisional Patent Application No. 62/531,631, filed Jul. 12, 2017.

BACKGROUND

The present invention relates to chairs, such as office chairs, and more particularly, to a multi-position chair.

In an office, business site, home office, or other like location, a person or employee often performs tasks while sitting or standing adjacent a desk, table, counter, or like work surface. In some instances, a work surface, such as a raised work surface, a high table, counter or the like, may permit or require a person to assume a standing position adjacent the work surface. For instance, a desk may be provided that permits the work surface to be readily elevated and lowered so that the individual user may decide whether to place the work surface at a height for standing or for sitting and may switch therebetween on a frequent basis.

In addition to seated and standing positions, a person may desire to be positioned at other ergonomic or comfortable positions relative to a work surface. For example, a so-called perching position may be desirable in which a person merely leans on an underlying support without necessarily being in a standard seated position and without having to stand without support.

Accordingly, a chair or other piece of furniture that may be readily reconfigurable to provide both sitting and perching positions adjacent a work surface is desired, particularly for a work surface that is adapted to be readily elevated and lowered throughout the course of a workday.

SUMMARY

According to an embodiment, a chair is provided having at least one leg for supporting a seat component. In addition, the chair includes a backrest interconnected to and projecting from the seat component. The backrest comprises a lower backrest section, an upper backrest section, and a backrest hinge interconnecting the upper backrest section to the lower backrest section. The lower backrest section is interconnected to and extends from a rear portion of the seat component. The backrest hinge is configured to permit the upper backrest section to pivot relative to the lower backrest section.

The backrest hinge is configured to permit the upper backrest section to be located in a backrest position in which the upper backrest section projects above the lower backrest section. In addition, the hinge is configured to permit the upper backrest section to be pivoted to a forwardly-folded position in which the upper backrest section extends laterally over and spaced above the seat component. Accordingly, when the upper backrest section is in the backrest position, a user may sit on the seat component and rest their back on the backrest (i.e., in a normal seated position or the like), and when the upper backrest section is in the forwardly-folded position, a user may sit, lean or perch on top of the upper backrest section (i.e., in a perching position or the like).

BRIEF DESCRIPTION OF THE DRAWINGS

The foregoing and other objects, features and advantages of the embodiments disclosed herein should become apparent from the following description when taken in conjunction with the accompanying drawings.

DETAILED DESCRIPTION

For simplicity and illustrative purposes, the principles of the embodiments are described by referring mainly to examples thereof. In the following description, numerous specific details are set forth in order to provide a thorough understanding of the embodiments. It will be apparent however, to one of ordinary skill in the art, that the embodiments may be practiced without limitation to these specific details. In some instances, well known methods and structures have not been described in detail so as not to unnecessarily obscure the embodiments.

According to an embodiment, various positions may be taken by a person sitting, leaning while sitting, perching or standing adjacent a work surface as shown, for instance, in FIGS. 1A, 1B, 1C, and 1D. Thus, a chair 10 or other article of furniture according to an embodiment may be readily converted into numerous different configurations, for instance, so that a person may select and quickly change to a desired, sitting, perching, or standing position.

Figures 1A, 1B, 1C, 1D:
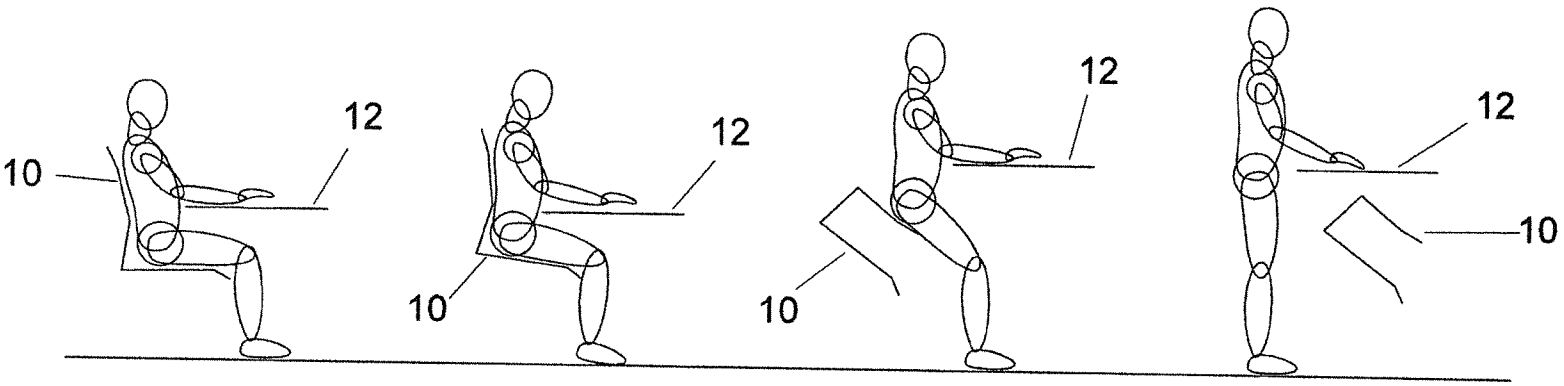
FIGS. 1A-1D are schematic views showing a chair configured to provide a normal sitting position relative to a work surface at a normal or lowered elevation (FIG. 1A), a chair configured to provide a forward leaning sitting position relative to a work surface at the normal or lowered elevation (FIG. 1B), a chair configured to provide a so-called perching position relative to an elevated work surface (FIG. 1C), and a person in a standing position relative to the work surface at the elevated position (FIG. 1D) according to an embodiment.

By way of example and as shown schematically in FIG. 1A, a person may assume a normal seated position on the office chair 10 or the like adjacent a work surface such as provided by a desk or table 12 in a relatively lowered or normal height position. FIG. 1B shows a similar seated position in which the chair is converted to enable the person to lean forward in the chair 10 relative to the desk or table 12. According to some embodiments, it may also be possible for the person to assume a relatively reclined seated position (not shown) in the chair. As shown in FIG. 1C, the chair 10 may be converted to permit a person to assume a so-called perching position on the chair 10 so that the person may utilize a desk or table 12 positioned at a relatively elevated or high height. Still further, as shown in FIG. 1D, the chair 10 may be stowed underneath the desk or table 12 so that the person may assume a standing position adjacent a heightened work surface. Thus, according to an embodiment, the chair 10 may be configured to permit normal sitting, at least one of rearward-reclining and forward-leaning in a seated position, perching, standing, or the like.

A more detailed embodiment of a multi-position chair 14 according to an embodiment is shown in FIGS. 2A-2D, 3, 4A-4B, 5A-5B, 6A-6B, and 7A-7B. The chair 14 includes a seat component 16 supported on and/or above one or more legs 18. The seat component 16 may have an upper surface that is padded or otherwise provides a comfortable seating surface for a user. The seat component 16 may have a lower surface facing the legs 18. In the illustrated embodiment, the chair 14 has four legs 18 including a front-right leg 18*a*, a front-left leg 18*b*, a rear-right leg 18*c*, and a rear-left leg 18*d*. Of course, the chair 14 may be designed to have fewer or more legs 18. In addition, in the illustrated embodiment, each leg 18 has a caster or swiveling wheel at a lower end thereof for ease in moving the chair 14 across a floor. The casters or swiveling wheels may be capable of being locked to prevent movement of the chair relative to the floor.

According to an embodiment, the chair 14 may be height adjustable relative to the floor on which the legs 18 are supported. For example, the upper part of each of the legs 18 may interconnect to and extend from a relatively vertically-oriented gas-spring assembly 20 or like support post. The gas-spring assembly 20 may be non-rotating and may be actuated by a lever 22 located below the right side of the seat component 16. Actuating the lever 22 may cause a relatively vertically-oriented seat support post 24 projecting from within the gas-spring assembly 20 to extend higher or lower relative to the housing of the gas-spring assembly 20 to elevate or lower the seat component 16 relative to the floor. The lever 22 may also be used to lock movement of the seat support post 24, and thus the seat component 16, at a desired height selected by the user. As an alternative (not shown), the chair may be configured to be a "fixed-height" chair such that the seat component is maintained at a non-adjustable height above the floor on which the legs of the chair are supported.

According to an embodiment, the seat component 16 of chair 14 interconnects to an upper end of the seat support post 24 via a seat hinge 26 adjacent a front-center part of the underside of the seat component 16. The seat hinge 26 may be provided in the form of a relatively horizontally-oriented gas-spring assembly 28 that is actuated by a lever 30 located underneath a left side of the seat component 16. The seat hinge 26 enables the seat component 16 to be pivoted about an axis "A" extending longitudinally through the relatively horizontally-extending gas-spring assembly 28.

Figures 2A, 2B, 2C, 2D:
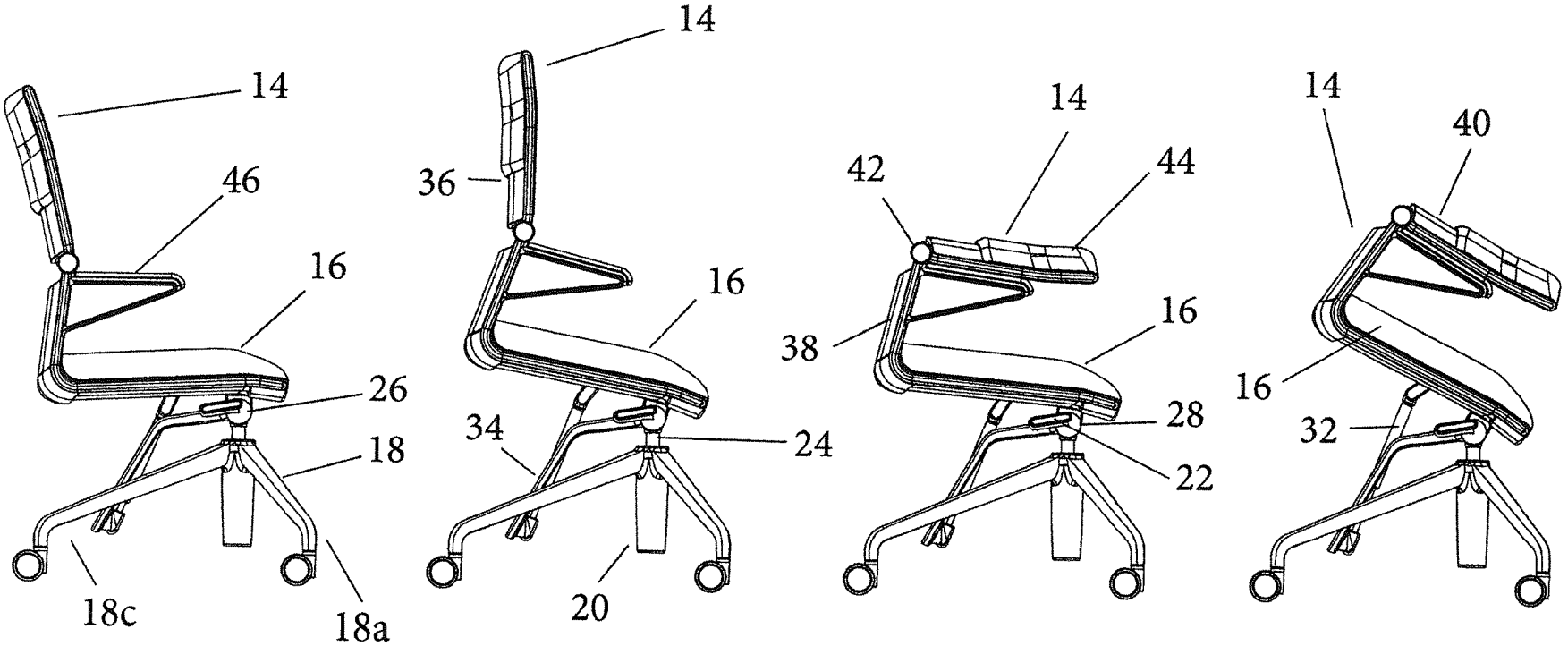
FIGS. 2A-2D are side elevation views of a chair able to be configured in sitting (FIG. 2A), forward-leaning sitting (FIG. 2B), stool (FIG. 2C), and perching (FIG. 2D) positions according to an embodiment.
Figure 3:
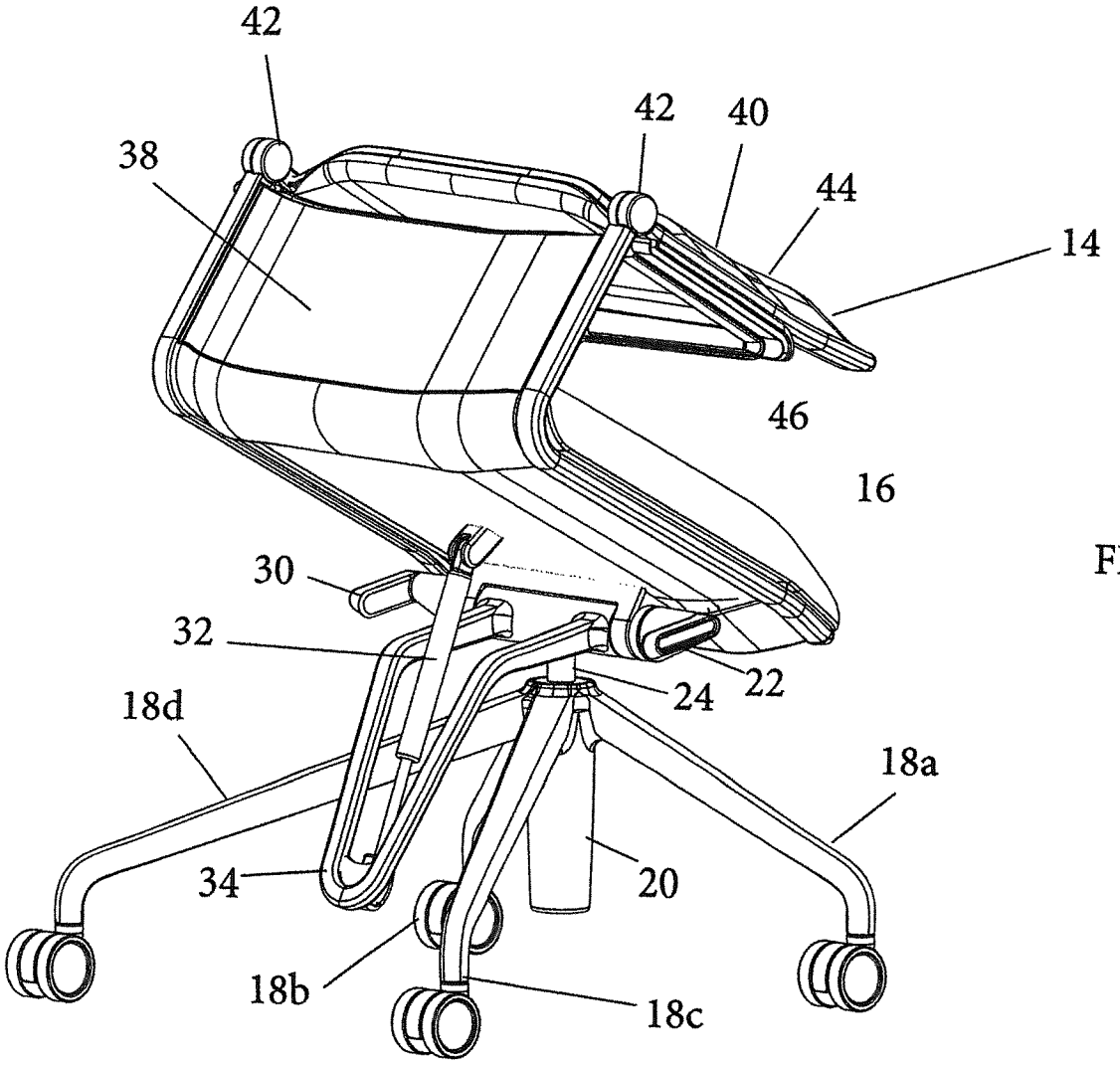
FIG. 3 is a rear perspective view of the chair shown in FIGS. 2A-2D in the perching position (FIG. 2D) according to an embodiment.
Figure 4B:
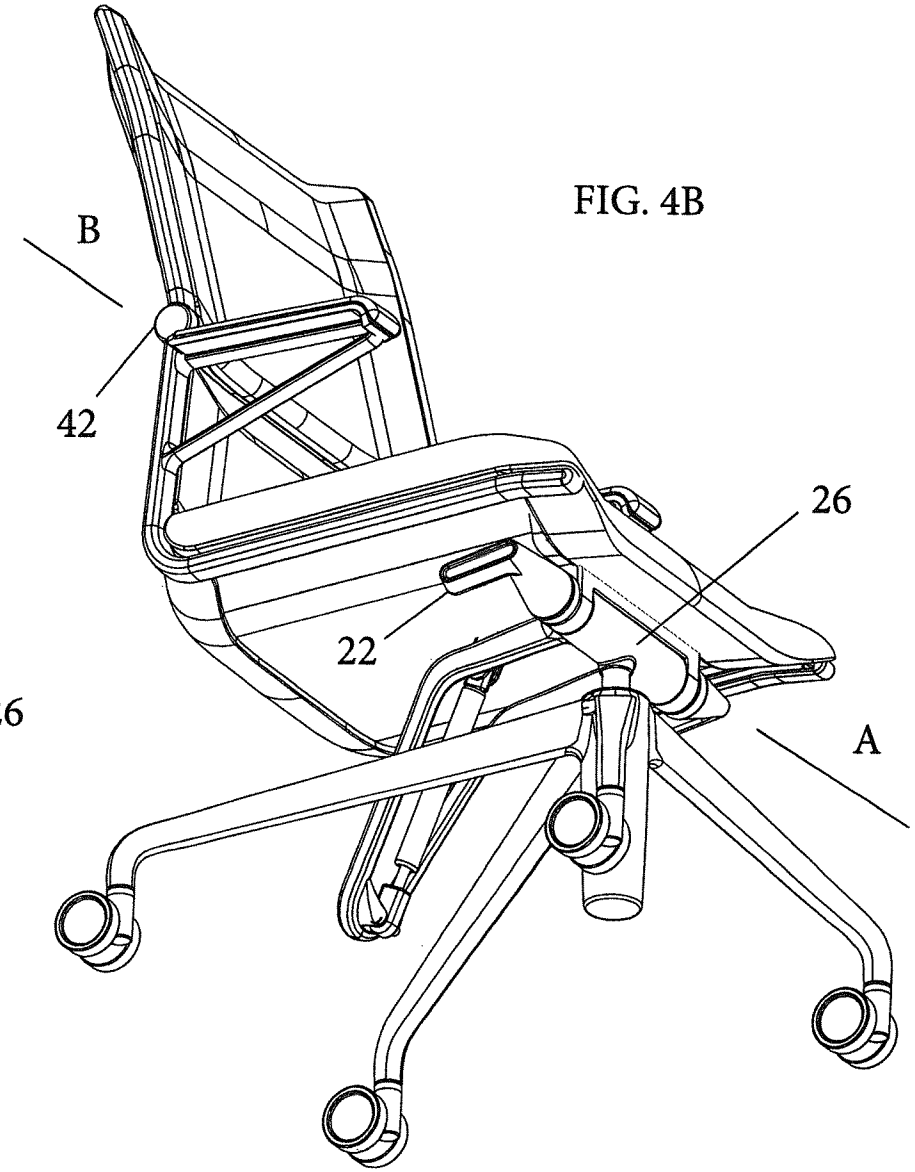
FIG. 4B is a perspective view of the chair shown in FIG. 4A.
Figure 4A:
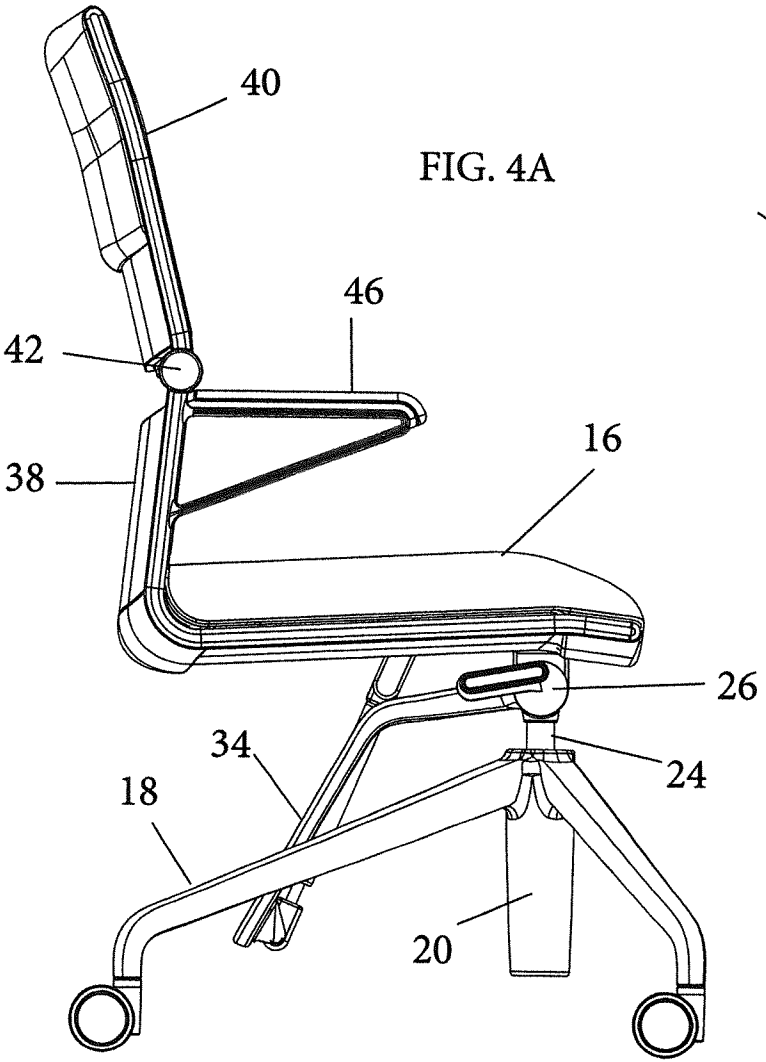
FIG. 4A is a side elevation view of the chair shown in FIGS. 2A-2D in the sitting position (FIG. 2A) according to an embodiment.
Figure 5B:
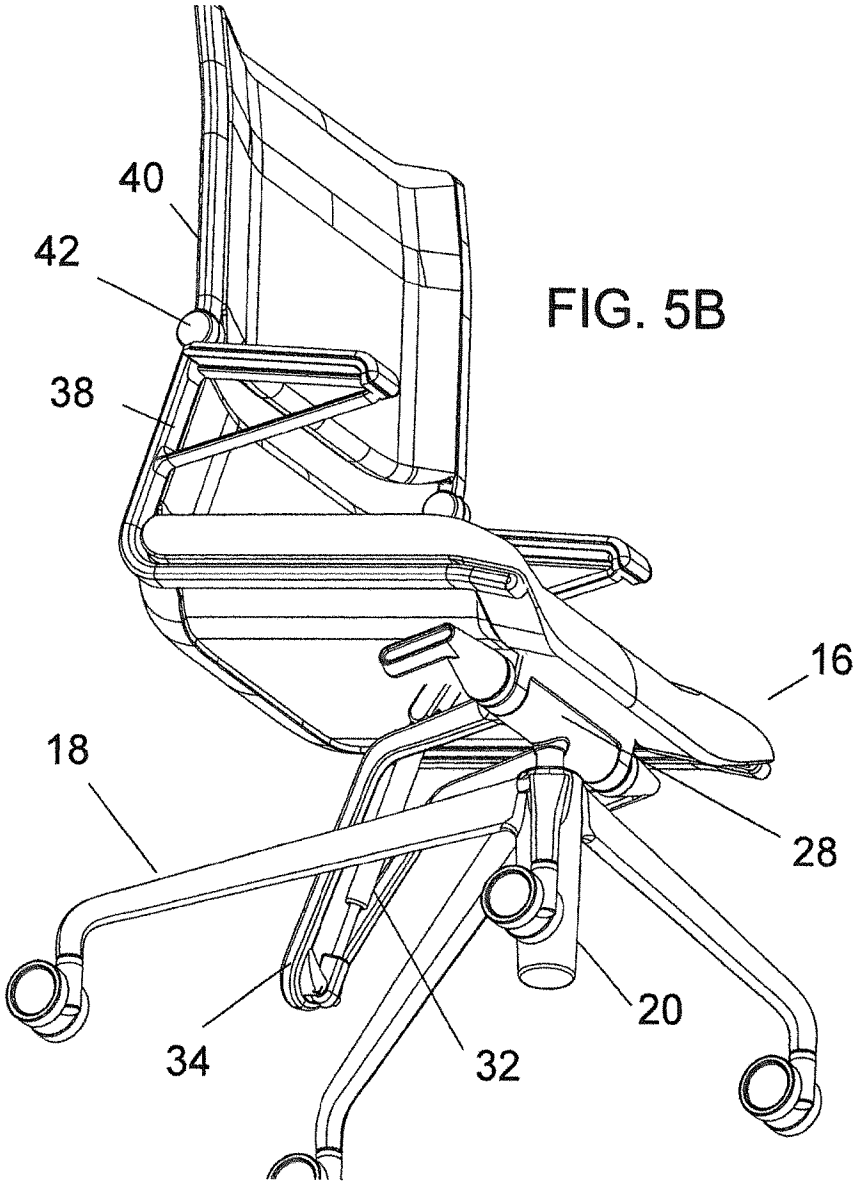
FIG. 5B is a perspective view of the chair shown in FIG. 5A.
Figure 5A:
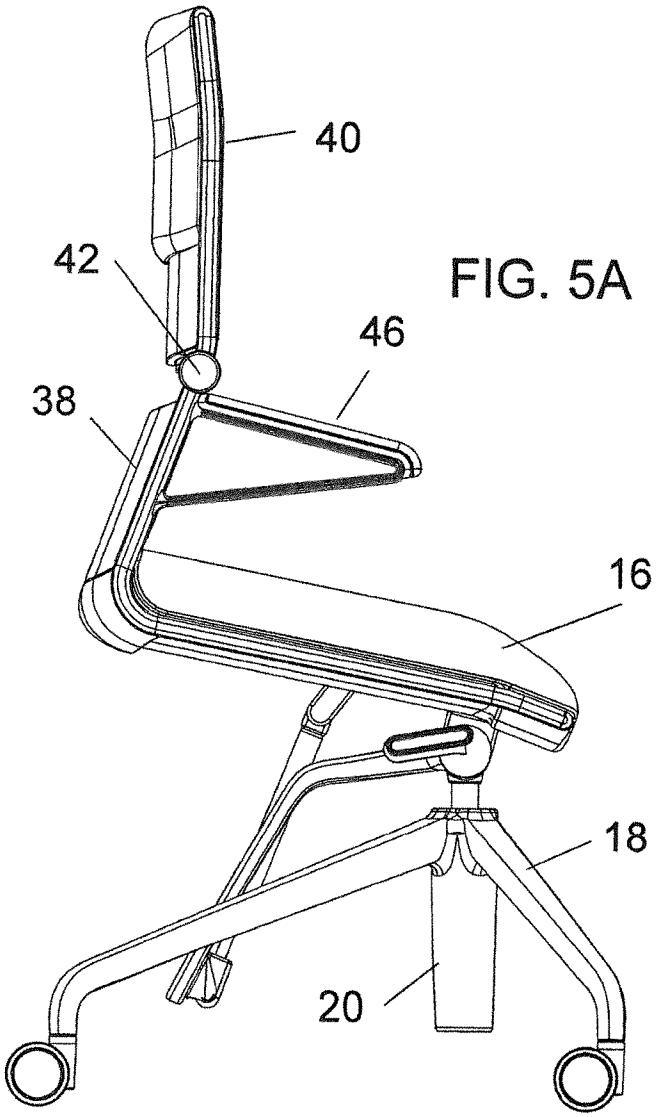
FIG. 5A is a side elevation view of the chair shown in FIGS. 2A-2D in the forward-leaning sitting position (FIG. 2B) according to an embodiment.
Figure 6B:
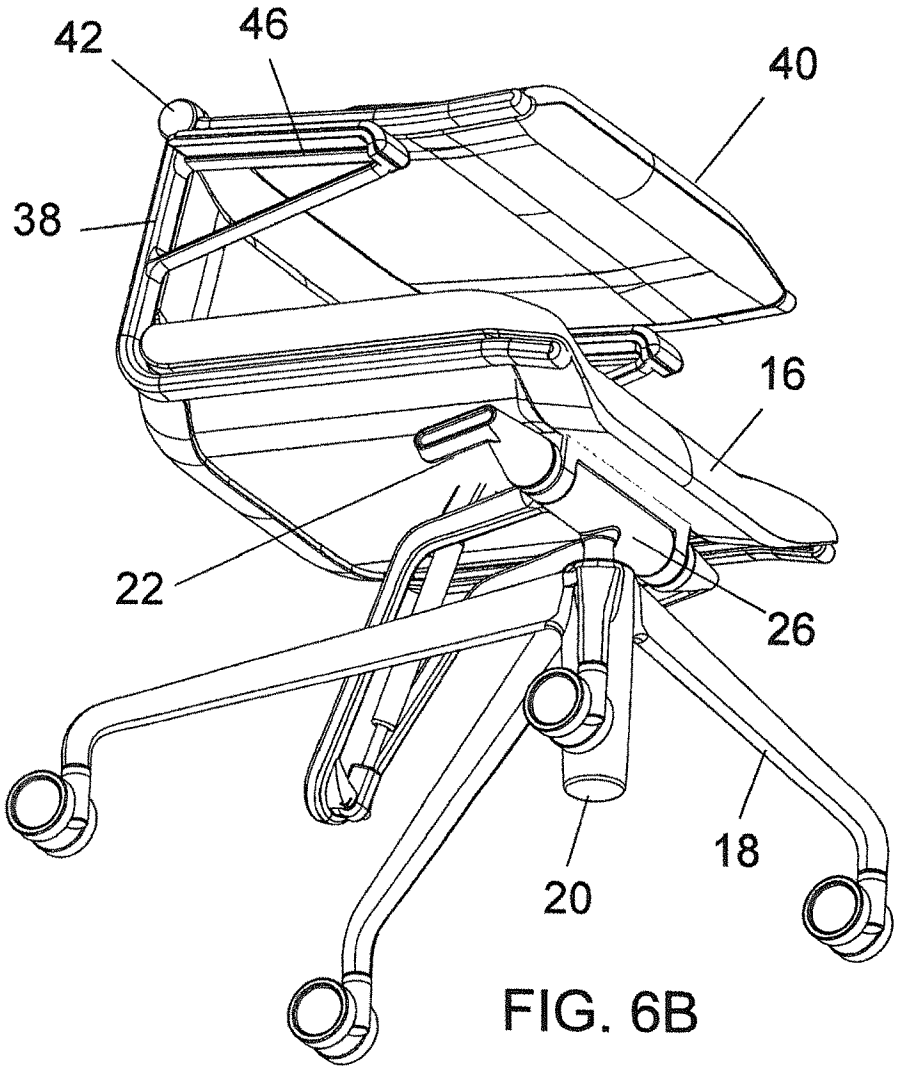
FIG. 6B is a perspective view of the chair shown in FIG. 6A.
Figure 6A:
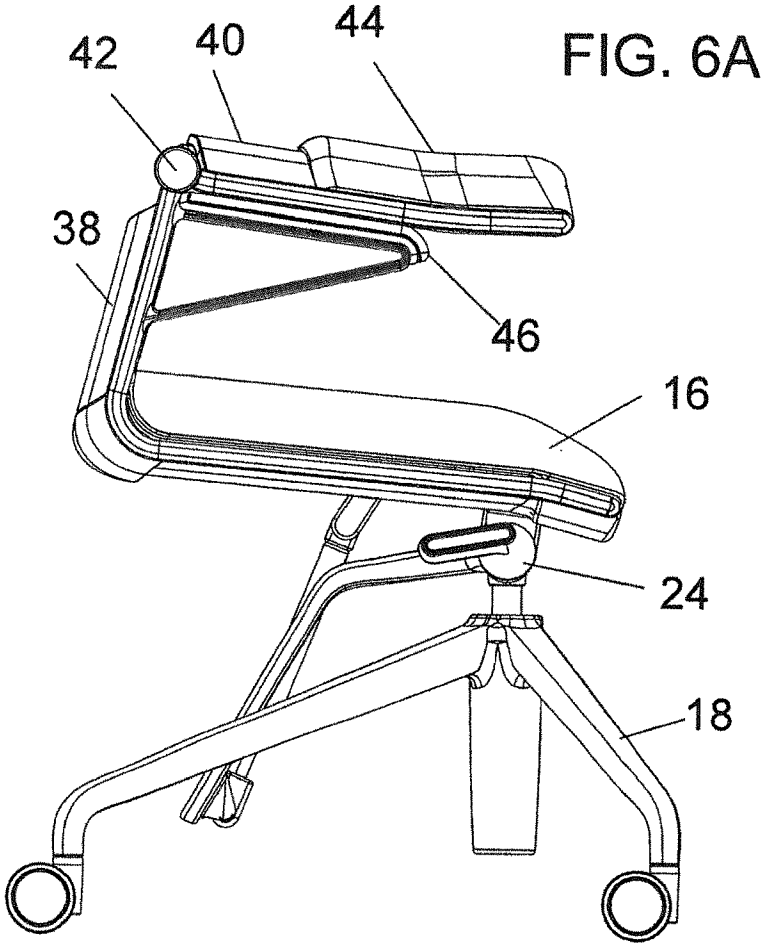
FIG. 6A is a side elevation view of the chair shown in FIGS. 2A-2D in the stool position (FIG. 2C) according to an embodiment.
Figure 7B:
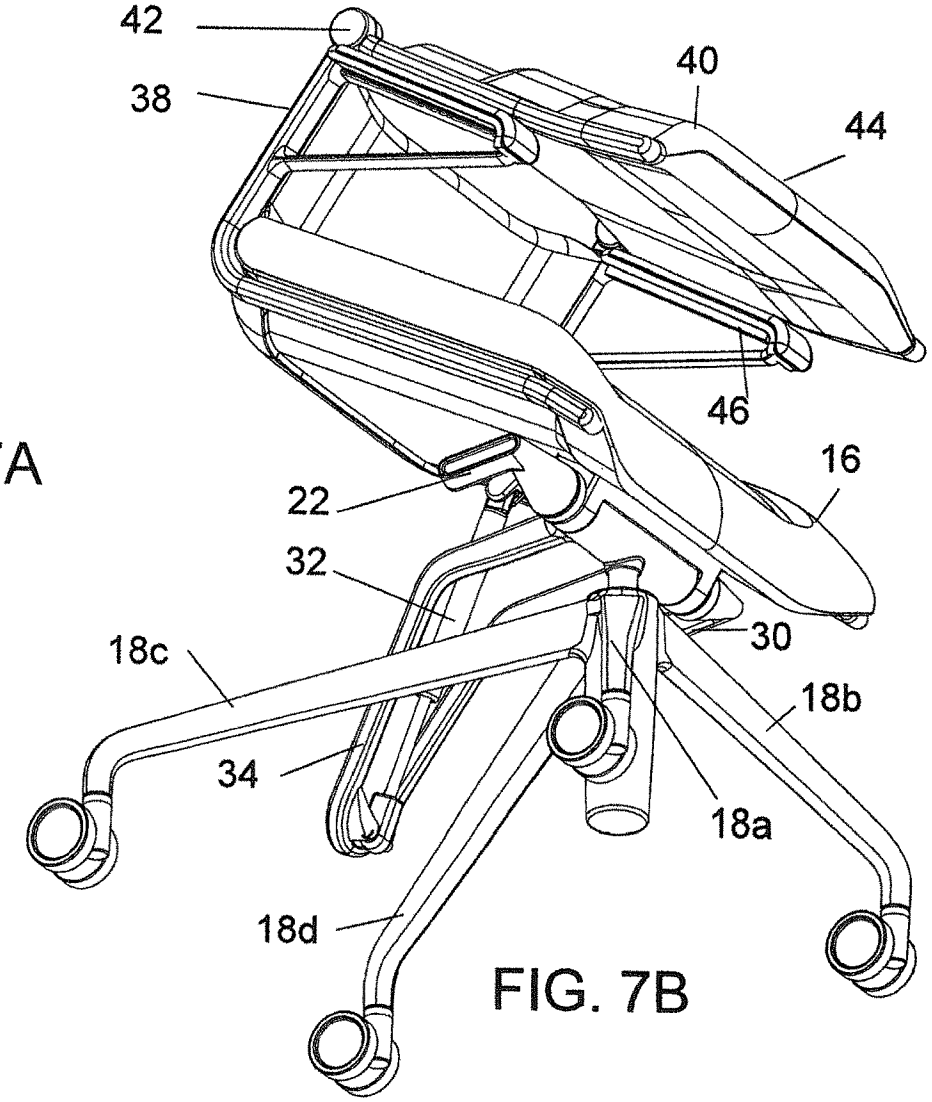
FIG. 7B is a perspective view of the chair shown in FIG. 7A.
Figure 7A:
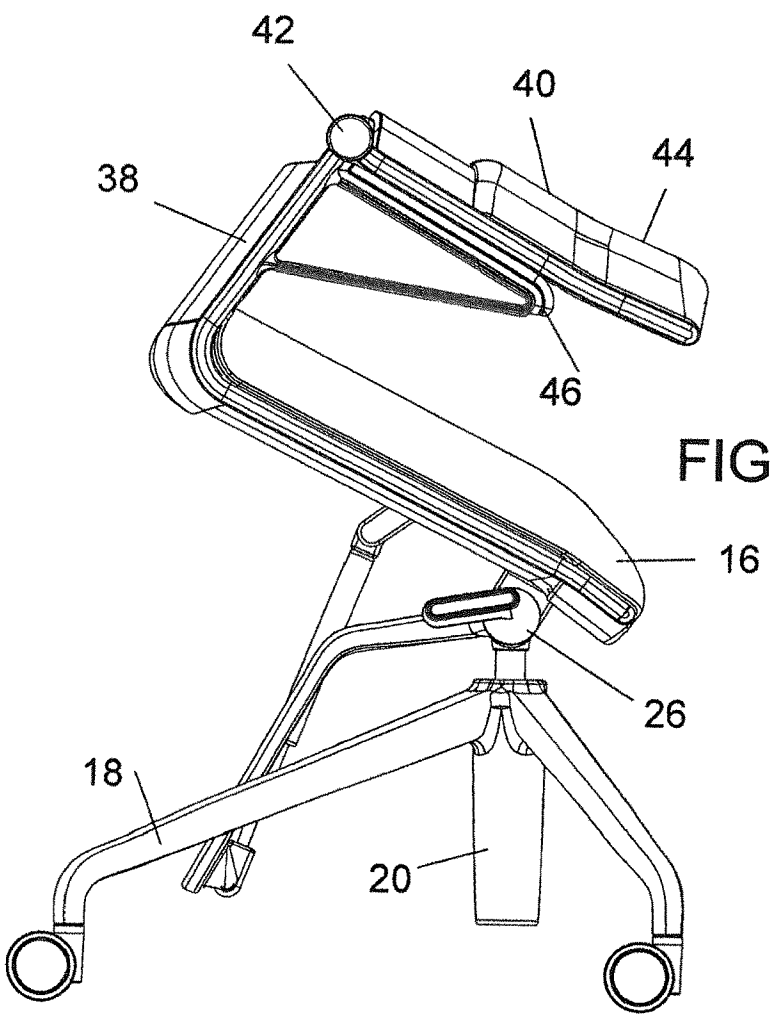
FIG. 7A is a side elevation view of the chair shown in FIGS. 2A-2D in the perching position (FIG. 2D) according to an embodiment.

With this arrangement, the seat component 16 may be positioned in a substantially horizontal position or slightly rearward-sloped position as shown in FIG. 2A, may be pivoted about axis "A" to a slightly forward-sloped or angled position such as shown in FIGS. 2B and 2C, or may be pivoted about axis "A" to a significantly forward-sloped or angled position as shown in FIG. 2D. The angle or slope of the seat component 16 may be altered by actuating the lever 30 of the gas-spring assembly 28 and may also be locked in the desired position/slope via use of the lever 30. By way of example, the angle or slope of the seat component relative 16 to the floor may be set within the range of 0° (i.e., level) to 30° or 45° or more. The seat component 16 may be locked at any angle within the range or may be set to lock at only a few discrete pre-determined positions within the range.

According to an embodiment, the chair 14 may have an additional spring or resilient member 32 having an upper end connected to and extending from a mid-point or other location on the underside of the seat component 16 and a lower end connected to and extending from a support bracket 34 extending behind the vertically-oriented gas-spring assembly 20 between the rear right and left legs, 18*c* and 18*d*. The connection of the spring 32 to the seat component 16 may enable the spring 32 to pivot relative to the seat component 16, and the support bracket 34 may extend from the gas spring assembly 28. The spring 32 provides further support for the seat component 16 in any desired sloped position and a shock-absorbing function.

Accordingly, a user may set and lock the general height of the seat component 16 above the floor via actuation of the lever 22 and may set and lock the slope of the seat component 16 relative to the floor via actuation of the lever 30. Thus, the seat component 16 may be provided in the position shown in FIG. 2A when a normal sitting position is desired (also see FIGS. 4A and 4B), in the position shown in FIG. 2B when a forward-leaning sitting position is desired (also see FIGS. 5A and 5B), in the position shown in FIG. 2C when sitting on a stool (without backrest) at a relatively higher height is desired (also see FIGS. 6A and 6B), or in the position shown in FIG. 2D when perching is desired (also see FIGS. 3 and 7A and 7B).

According to an embodiment, the chair 14 may include a backrest 36 that extends generally upward from a rear of the seat component 16 as shown in FIGS. 2A and 2B. For instance, in the seated positions shown in FIGS. 2A and 2B, the backrest 36 is in a generally upright position for supporting the back of a user sitting on the upper surface of the seat component 16 of the chair 14 in a standard or forward-leaning sitting position.

The backrest 36 may include a lower backrest section 38 extending from a rear edge of the seat component 16, such as in a fixed position, and a separate upper backrest section 40 interconnected to the lower backrest section 38 via one or more backrest hinges 42. In the illustrated embodiment, a pair of backrest hinges 42 are shown, one at the left side of the backrest 36 and one at the right side of the backrest 36. As an alternative, a single backrest hinge may be used or more than two backrest hinges may be used. The backrest hinge(s) 42 provide a substantially horizontal pivot axis "B" about which the upper backrest section 40 may be pivoted or folded relative to the lower backrest section 38.

By way of example, the upper backrest section 40 may be positioned generally upright from the lower backrest section 38 as shown in FIGS. 2A and 2B or may be pivoted forward relative to the lower backrest section 38 such that the upper backrest section 40 is positioned to extend laterally over and spaced above the seat component 16 as shown in FIGS. 2C and 2D. In the illustrated embodiment, the upper backrest section 40 of the chair 14 in the forward-folded position extends substantially parallel to the seat component 16 at a spaced distance thereabove. The rear surface 44 of the upper backrest section 40 may be padded and/or provided with a non-slip surface since it provides an upward facing surface on which the user may sit in the stool position shown in FIG. 2C or may lean or perch in the perch position shown in FIG. 2D. Thus, when the chair 14 is converted to the position shown in FIG. 2C, it provides an elevated backless seat, such as provided by a stool. Also, when the chair 14 is converted to the position shown in FIG. 2D, it provides an angled or sloped elevated seat on which the user may perch such as shown in FIG. 1D discussed above.

Accordingly, the user merely adjusts the height and slope of the seat component 16 with levers 22 and 30, sets or locks the seat component 16 in the desired position, and pivots or folds the upper backrest section 40 to the forward lateral position or to the upright position to convert the chair into any of the positions shown in FIGS. 2A-2D. The position of these components of the chair may be reset readily and repeatedly throughout a day at the desire of the end user.

According to an embodiment, the chair 14 may be provided with a pair of armrests 46. In the illustrated embodiment, the armrests 46 extend forwardly from the lower backrest section 38 adjacent the right and left sides of the seat component 16. The arm-supporting upper surface of the armrests 46 may be provided at a level adjacent and below the backrest hinge(s) 42. Accordingly, the upper backrest section 40 of the chair 14 may be supported directly on the armrests 42 when the upper backrest section 40 is pivoted or folded forward such as in the stool and perch positions shown in FIGS. 2C and 2D. As an alternative, a chair may be provided without armrests and/or the upper backrest section of the backrest may be supported by an internal locking feature of the backrest hinge 42 when the upper backrest section 40 is folded forward.

The various components described above may be made of metallic, non-metallic, wooden, plastic, resins, composite, fabric or materials from which chairs may be made. The gas-spring assemblies may be replaced with any type of resilient and lockable component permitting height adjustment and/or slope adjustment of the seat component.

The above description illustrates an embodiment of how aspects of the present invention may be implemented, and are presented to illustrate the flexibility and advantages of particular embodiments as defined by the following claims, and should not be deemed to be the only embodiments. One of ordinary skill in the art will appreciate that based on the above disclosure and the following claims, other arrangements, embodiments, implementations and equivalents may be employed without departing from the scope hereof as defined by the claims.

Accordingly, the specification and figures are to be regarded in an illustrative rather than in a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims.

We claim:

1. An office chair, comprising:

a seat component supported by and above at least one leg; and a backrest interconnected to and projecting from a rear portion of said seat component;

said backrest comprising a lower backrest section, an upper backrest section, and a backrest hinge interconnecting said upper backrest section to said lower backrest section, said lower backrest section being interconnected to and extending upwardly from said seat component in a fixed position relative to said seat component, and said upper backrest section having opposite front and rear surfaces; and said backrest hinge permitting said upper backrest section to pivot relative to said lower backrest section to permit said upper backrest section to be located in an upright position in which said upper backrest section projects from said lower backrest section and to permit said upper backrest section to be pivoted to a forward position in which said upper backrest section extends laterally over said seat component;

wherein an underside of said seat component interconnects to said at least one leg via a seat hinge such that the seat component can be pivoted and locked in a generally horizontal position and in a forward-inclined position about said seat hinge;

wherein said office chair is reconfigurable from a normal sitting configuration, in which said upper backrest section is in said upright position allowing a user to sit on said seat component and rest their back on said front surface of said upper backrest section, to a perching configuration, in which said upper backrest section is in said forward position extending laterally over said seat component and said seat component is locked in the forward-inclined position allowing a user to perch directly on said rear surface of said upper backrest section which is forwardly-inclined with said seat component.

2. The office chair according to claim 1, wherein, when said upper backrest section is in said forward position, said upper backrest section is spaced above said seat component.

3. The office chair according to claim 2, wherein, when said upper backrest section is in said forward position, said upper backrest section extends substantially parallel to said seat component.

4. The office chair according to claim 1, wherein said seat hinge is provided by a horizontally-disposed gas spring assembly actuated with a lever.

5. The office chair according to claim 1, wherein said at least one leg interconnects to a height adjustment mechanism having a support post projecting therefrom and interconnecting to said seat hinge whereby a height to which the support post projects from the height adjustment mechanism is adjustable.

6. The office chair according to claim 5, wherein the height adjustment mechanism is provided by a gas-spring assembly.

7. The office chair according to claim 1, wherein a shock absorbing member extends from the underside of the seat component to a support bracket extending below said underside of the seat component.

8. The office chair according to claim 1, further comprising a pair of arm rests extending forwardly of said lower backrest section.

9. The office chair according to claim 8, wherein, when said upper backrest section is pivoted to said forward position about said backrest hinge, said upper backrest section is supported on said pair of arm rests.

10. The office chair according to claim 9, wherein an upper surface of said pair of arm rests extends adjacent and below said backrest hinge.

11. The office chair according to claim 1, wherein, when said upper backrest section is pivoted to said forward position about said backrest hinge, said upper backrest section is supported above said seat component by an internal locking feature of the backrest hinge.

12. The office chair according to claim 1, wherein said rear surface of said upper backrest section is padded or is provided as a non-slip surface.

13. A chair, comprising: a seat component interconnect to at least one leg via a seat hinge such that said seat component is configured to be pivoted from a generally horizontal position and to a forward-inclined position; and a backrest interconnected to and projecting from a rear portion of said seat component; said backrest comprising a lower backrest section, an upper backrest section, and a backrest hinge interconnecting said upper backrest section to said lower backrest section, said lower backrest section being interconnected to and extending upwardly from said seat component in a fixed position relative to said seat component, and said upper backrest section having opposite front and rear surfaces; said backrest hinge permitting said upper backrest section to pivot relative to said lower backrest section from an upright position in which said upper backrest section projects from said lower backrest section to a forward position in which said upper backrest section extends laterally over said seat component; and said office chair being reconfigurable from a normal sitting configuration, in which said upper backrest section is in said upright position thereby allowing a user to sit on said seat component and rest their back on said front surface of said upper backrest section, to a perching configuration, in which said upper backrest section is in said forward position extending laterally over said seat component and said seat component is locked in the forward-inclined position allowing a user to perch directly on said rear surface of said upper backrest section which is forwardly-inclined with said seat component.

14. The chair according to claim 13, wherein, when said upper backrest section is in said forward position, said upper backrest section is spaced above said seat component.

15. The chair according to claim 14, wherein, when said upper backrest section is in said forward position, said upper backrest section extends substantially parallel to said seat component.

16. The chair according to claim 15, wherein said at least one leg interconnects to a height adjustment mechanism having a support post projecting therefrom and interconnecting to said seat hinge whereby a height to which the support post projects from the height adjustment mechanism is adjustable.

17. The chair according to claim 13, wherein said rear surface of said upper backrest section is padded or is provided as a non-slip surface.

* * * * *